US012171266B2

(12) United States Patent
Ruscio et al.

(10) Patent No.: US 12,171,266 B2
(45) **Date of Patent: *Dec. 24, 2024**

(54) AEROSOL-GENERATING DEVICE WITH EASY CLEAN HEATING CHAMBER

(71) Applicant: Philip Morris Products S.A., Neuchatel (CH)

(72) Inventors: Dani Ruscio, Neuchatel (CH); Keethan Dasnavis Fernando, Neuchatel (CH); Boris Mahler, Neuchatel (CH); Patrick Mauroux, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 0 days.

This patent is subject to a terminal disclaimer.

(21) Appl. No.: 18/340,328

(22) Filed: Jun. 23, 2023

(65) Prior Publication Data

US 2023/0329345 A1 Oct. 19, 2023

Related U.S. Application Data

(62) Division of application No. 16/956,154, filed as application No. PCT/EP2018/085682 on Dec. 18, 2018, now Pat. No. 11,723,408.

(30) Foreign Application Priority Data

Dec. 22, 2017 (EP) ..... 17210344

(51) Int. Cl.
*A24F 13/00* (2006.01)
*A24F 40/46* (2020.01)
(Continued)

(52) U.S. Cl.
CPC ..... *A24F 40/46* (2020.01); *A24F 40/465* (2020.01); *A24F 40/20* (2020.01); *A24F 40/85* (2020.01)

(58) Field of Classification Search
CPC ..... A24F 47/00
(Continued)

(56) References Cited

U.S. PATENT DOCUMENTS 1,074,489 A 9/1913 Broz
5,665,262 A 9/1997 Hajaligol et al.
(Continued)

FOREIGN PATENT DOCUMENTS

CN 105341994 A 2/2016
CN 107411179 A 12/2017
(Continued)

OTHER PUBLICATIONS

Korean Office Action issued Feb. 6, 2024 in corresponding Korean Patent Application No. 10-2020-7019991 (with English translation), 7 pages.
(Continued)

*Primary Examiner* — Phuong K Dinh
(74) *Attorney, Agent, or Firm* — Oblon, McClelland, Maier & Neustadt, L.L.P.

(57) ABSTRACT

An aerosol-generating device is provided for heating an aerosol-forming substrate to form an inhalable aerosol, the aerosol-generating device including: a heating chamber configured to heat an aerosol-forming substrate, the heating chamber comprising a first end having an opening, a second end having a base, and a side wall extending between the opening and the base, in which a cavity is defined by inner surfaces of the base and side wall; a heating assembly; and a power supply, the heating assembly including a heater extending into the heating chamber through an inner portion of the base, and the inner portion of the base being contoured to provide a chamfered or filleted intersection between the base and the heater.

13 Claims, 5 Drawing Sheets

(51) Int. Cl.
*A24F 40/465* (2020.01)
*A24F 40/20* (2020.01)
*A24F 40/85* (2020.01)

(58) Field of Classification Search
USPC ..... 131/328–329
See application file for complete search history.

(56) References Cited

U.S. PATENT DOCUMENTS

| | | | | |
|---|---|---|---|---|
| 5,726,421 | A | 3/1998 | Fleischhauer et al. | |
| 10,299,514 | B2 | 5/2019 | Bilat | |
| 11,723,408 | B2 * | 8/2023 | Ruscio | A24F 40/465 131/329 |
| 2003/0154991 | A1 | 8/2003 | Fournier et al. | |
| 2013/0037041 | A1 | 2/2013 | Worm et al. | |
| 2015/0013696 | A1 | 1/2015 | Plojoux et al. | |
| 2015/0238050 | A1 | 8/2015 | Lee | |
| 2015/0272225 | A1 | 10/2015 | Worm et al. | |
| 2016/0302486 | A1 | 10/2016 | Eroch | |
| 2018/0192707 | A1 | 7/2018 | Worm et al. | |
| 2019/0053541 | A1 | 2/2019 | Rojo-Calderon | |
| 2019/0075848 | A1 | 3/2019 | Worm et al. | |
| 2019/0274358 | A1 * | 9/2019 | Reevell | A24F 7/00 |

FOREIGN PATENT DOCUMENTS

| | | | |
|---|---|---|---|
| EP | 3003076 | A2 | 4/2016 |
| GB | 190137 | A | 5/1923 |
| JP | 7-21608 | U | 4/1995 |
| JP | 2003-237777 | A | 8/2003 |
| JP | 2007-32246 | A | 2/2007 |
| JP | 2007-205702 | A | 8/2007 |
| JP | 2008-122147 | A | 5/2008 |
| JP | 2012-513750 | A | 6/2012 |
| JP | 2013-150593 | A | 8/2013 |
| JP | 2014-533513 | A | 12/2014 |
| JP | 2017-514463 | A | 6/2017 |
| JP | 2017-519493 | | 7/2017 |
| JP | 2017-163975 | A | 9/2017 |
| KR | 2017-0115492 | | 10/2017 |
| RU | 2 609 395 | C2 | 2/2017 |
| WO | WO 95/27412 | A1 | 10/1995 |
| WO | WO 2013/022936 | A1 | 2/2013 |
| WO | WO 2013/076098 | A2 | 5/2013 |
| WO | WO 2013/102614 | A2 | 7/2013 |
| WO | WO 2016/124550 | A1 | 8/2016 |
| WO | WO 2016/207407 | | 12/2016 |
| WO | WO 2017/068099 | A1 | 4/2017 |
| WO | WO 2017/186455 | A1 | 11/2017 |

OTHER PUBLICATIONS

International Search Report and Written Opinion issued on Apr. 2, 2019 in PCT/EP2018/085682 filed on Dec. 18, 2018.

Russian Office Action and Search Report issued Dec. 21, 2021 in Russian Patent Application No. 2020123607/03 (040836) (with English language translation), 12 pages.

Extended European Search Report issued Feb. 24, 2022 in European Patent Application No. 21206323.4, 12 pages.

Notice of Reasons for Rejection issued Nov. 30, 2022 in Japanese Patent Application No. 2020-532757 (with English language translation), 10 pages.

Japanese Notice of Reasons for Refusal mailed on Aug. 19, 2024, issued in Japanese Patent Application No. 2020-532757, with Machine-generated English Translation, total 20 pages.

* cited by examiner

AEROSOL-GENERATING DEVICE WITH EASY CLEAN HEATING CHAMBER

CROSS-REFERENCE TO RELATED APPLICATIONS

This application is a divisional of and claims benefit under 35 U.S.C. § 120 to U.S. application Ser. No. 16/956,154, filed Jun. 19, 2020, which is a U.S. National Stage application of PCT/EP2018/085682, filed on Dec. 18, 2018, which is based upon and claims the benefit of priority under 35 U.S.C. § 119 from European Patent Application No. 17210344.2, filed Dec. 22, 2017, the entire contents of each of which are incorporated herein by reference.

TECHNICAL FIELD

The present invention relates to aerosol-generating devices for heating aerosol-forming substrate to form an inhalable aerosol. In particular, the invention relates to devices that include a heating chamber that is easy to clean.

DESCRIPTION OF THE RELATED ART

Devices for generating aerosols for inhalation by a user are known in the art. Such devices typically include a heating chamber to receive an aerosol-generating article comprising an aerosol-forming substrate. Such devices typically also include a heater assembly configured to heat the aerosol-forming substrate within the heating chamber in order to generate the inhalable aerosol. For example, WO 2013/102614 discloses an aerosol-generating device comprising a heating chamber for receiving an aerosol-generating article comprising a solid aerosol-forming substrate. In use, the aerosol-generating article is inserted into the heating chamber and impaled on a heater that is disposed within the chamber. The heater can be activated to heat the aerosol-forming substrate and generate an aerosol. After consumption, the aerosol-generating article is removed from the device and discarded.

Insertion, removal and heating of aerosol-forming substrates in such an aerosol-generating device typically creates residues, such as loose debris, within the heating chamber. Residue from the heating process may accumulate on heaters, in particular on internal heaters that penetrate into the substrate. Residue may also accumulate on inner walls of the heating chamber. Particles or pieces of aerosol-forming substrate from the aerosol-generating article may come loose and be released into the heating chamber when the aerosol-forming substrate is inserted or removed from the heating chamber. These forms of debris may accumulate within the heating chamber over time and multiple uses of the device. In particular, debris may accumulate around the base or closed end of the heating chamber. If there is an internal heater, debris may also accumulate around the base of the heater. Accumulated debris may hinder the effective operation of the device, for example by absorbing some of the heat from the heater that is intended for heating of the aerosol-forming substrate, by affecting airflow through the device, or by inhibiting insertion and removal of aerosol-generating articles.

The heating chamber of an aerosol-generating device is typically sized and shaped to closely accommodate a portion of an aerosol-generating article. Thus, for example, a heating chamber for accommodating an end of an aerosol-generating article shaped like a traditional cigarette may be a cylindrical heating chamber having dimensions slightly larger than the external dimensions of the end of the article. It is typically desirable to clean the heating chamber of an aerosol-generating device between uses to minimise the build-up of residue and debris. It is known to insert a brush into the heating chamber, between uses, to dislodge and remove accumulated residue. However, due to the typically small size of a heating chamber in an aerosol-generating device, and the presence of sharp angles within the heating chamber, a brush may not be completely effective at removing accumulated residue. It would be desirable to aid the cleaning further to make it more effective.

SUMMARY

In an aspect of the invention, there is provided an aerosol-generating device for heating an aerosol-forming substrate to form an inhalable aerosol. The aerosol-generating device comprises a heating chamber for heating an aerosol-forming substrate. The heating chamber comprises a first end having an opening, a second end having a base, and a side wall extending between the opening and the base, in which a cavity is defined by inner surfaces of the base and side wall. A peripheral portion of the base is contoured to provide a chamfered or filleted intersection between the inner surfaces of the base and the side wall.

BRIEF DESCRIPTION OF THE DRAWINGS

Particular embodiments will now be discussed in detail and shown by way of example only in the following figures, in which.

DETAILED DESCRIPTION

Figure 1A:
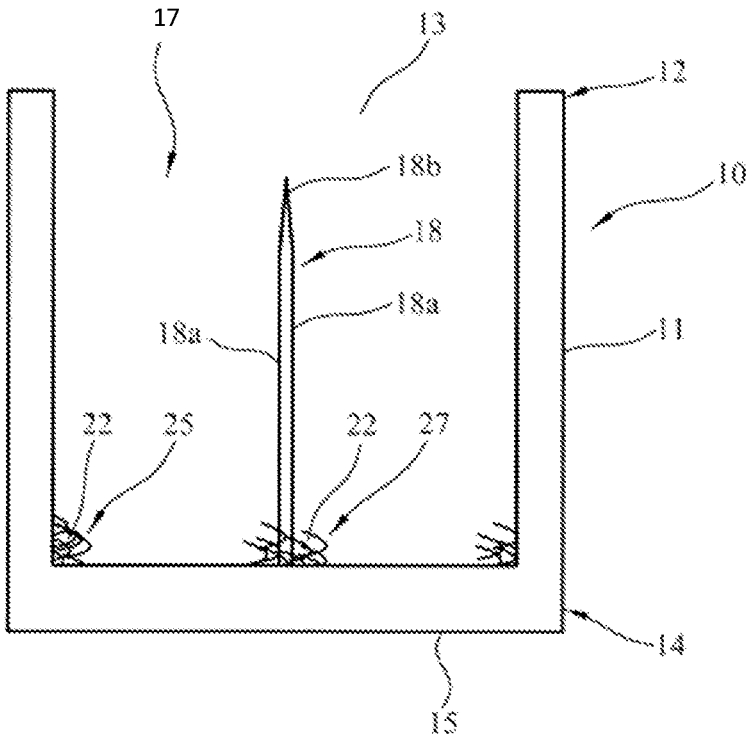
FIG. 1*a* shows a cut-through view of a conventional internally heated heating chamber.

As used herein, the term 'intersection' refers to a region where two surfaces meet. For example, an intersection is formed in the heating chamber at the region where the internal surface of the side wall meets the internal surface of the base. In some embodiments, the device may comprise a heater extending into the heating chamber through the base, and an intersection may also be formed at the region where the base meets a surface of the heater. An intersection as used herein typically refers to surfaces that meet at an angle less than 180°. Such intersections may be referred to as internal corners. In heating chambers of aerosol-generating devices, such as the aerosol-generating device of the present invention, intersections between surfaces are typically about 90°, as surfaces, such as the internal surfaces of the base and side wall, typically extend substantially perpendicularly to each other. Intersections with angles substantially equal to or less than 90° may be difficult to clean, as inserting a tool, such as a brush, into the small spaces created by such sharp angles may be difficult.

It is desirable for intersections between surfaces within the heating chamber to have angles greater than 90°, to facilitate cleaning of the heating chamber. Intersections or internal corners between surfaces in the heating chamber may have angles greater than 90° and less than 180°.

The heating chamber disclosed herein has a base that is contoured, such that the intersection between the internal surfaces of the base and side wall is chamfered or filleted. Such a chamfered or filleted intersection may reduce the difficulty of cleaning the intersection between the internal surfaces of the base and side wall in the heating chamber.

As used herein, the term 'chamfer' relates to a substantially straight transitional edge between two surfaces. Providing a straight transitional edge between two surfaces that would otherwise meet at a sharp internal corner (an intersection with an angle of less than 180°) may replace the sharp angle that would be created at the intersection between the two surfaces with two intersections (a first intersection between the first surface and the transitional edge and a second intersection between the second surface and the transitional edge), each of which has an angle that is larger or less sharp than the angle of the intersection between the two surfaces.

For example, a heating chamber may have a base and a sidewall with internal surfaces that extend substantially perpendicularly to each other and meet at an intersection with an angle of 90°. However, if the base is contoured at its periphery to provide a chamfered intersection between the internal surfaces of the base and sidewall, in accordance with the invention, a straight transitional edge is provided between the base and sidewall. If the straight transitional edge at the periphery of the base is angled to the general plane of the base at 135°, the straight transition edge also intersects the sidewall at 135°. Thus, the chamfered intersection between the base and sidewall may be considered to comprise two intersections of 135°, replacing a single intersection between the base and sidewall of 90°

As used herein, the term 'fillet' relates to a curved transitional edge between two surfaces. Providing a curved transitional edge between two surfaces that would otherwise meet at a sharp intersection or internal corner may replace the sharp angle that would be created at the intersection between the two surfaces with a curve having a lower curvature than the sharp intersection between the two surfaces.

The chamfer or fillet provided by the contoured base effectively fills in the section of the intersection between the internal surfaces of the base and side wall that may be particularly difficult to clean.

The side wall of the heating chamber may extend in a direction substantially perpendicular to the base. As used herein, the term 'perpendicular' relates to a substantially orthogonal relative orientation of two parts of the device or system, such as the relative orientation between the base and the side wall of the heating chamber. Typically, the side wall extends away from the base and substantially circumscribes the base to define the cavity of the heating chamber. In some embodiments, the side wall may be physically connected to the base. In some embodiments, the base may be separable from the side wall and movable relative to the side wall.

Debris may accumulate at intersections or internal corners within the heating chamber, such as where the base at the second, closed end of the heating chamber meets the side wall and where a heater projects upwards from the base. In order to clean debris from the heating chamber, a cleaning tool, such as a brush, may be inserted through the opening of the heating chamber and moved over the internal surfaces to dislodge residue, such as loose debris. In existing devices, some of the internal corners or intersections within the heating chamber may have angles of 90° or less, which are difficult to access with a cleaning tool. Thus, it may be difficult to adequately remove accumulated debris from these heating chambers. Where a peripheral portion of the base is contoured to provide a chamfered or filleted intersection, in accordance with the present invention, the sharp angled intersection between the base and the side wall may be effectively filled in. By filling in the sharp angle created at intersections between surfaces within the heating chamber, it may be easier for a cleaning tool, such as a brush, to access all portions of the internal surface of the heating chamber, thereby helping to make the cleaning process quicker and more efficient.

The peripheral portion of the base is the external or circumferential portion of the base around where the base meets or abuts the side wall. The peripheral portion of the base is radially outwards of an inner portion of the base. The inner portion of the base may be substantially planar and extend substantially in a plane. The plane of the inner portion may be substantially perpendicular to the side wall of the heating chamber. Contouring the peripheral portion so that the peripheral portion extends upwards, towards the opening of the heating chamber, from the inner portion of the base in a chamfer with a straight edge, may enable the peripheral portion of the base to meet the side wall of the heating chamber at an angle that is larger than without the contouring. Contouring the peripheral portion so that the peripheral portion extends upwards, towards the opening of the heating chamber, from an inner portion of the base in a curve until it is substantially parallel with the side wall (typically perpendicular to the base) may enable the peripheral portion to be parallel with the side wall at the point where the two surfaces meet. Both types of contouring may prevent sharp angles from being formed between the internal surfaces of the base and side wall by creating a chamfered or filleted intersection between the internal surfaces of the base and side wall.

Angels created at a chamfered intersection or a filleted intersection preferably are greater than approximately 90°, greater than about 100°, greater than about 110°, greater than about 120°, or greater than about 135°. In other words, a chamfered or filleted intersection provides angles that are all relatively open, so they are easy to access with a brush in order to be cleaned. A brush can more easily access the chamfered or filleted intersections to dislodge accumulated debris. In particular, a filleted intersection can be configured to have a concave curve with a curvature that matches the curvature of the convex profile of a brush head. For example, a filleted intersection may be shaped to match the profile of a standard rounded brush. This ensures that a brush can reach all parts of the filleted intersection without having to be substantially deformed. This may enable the brush to reach all areas of the heating chamber more easily and thus improve the cleaning efficiency of the brush.

The heating chamber of the present invention has at least one side wall. Where the heating chamber has a single side wall, the side wall may extend substantially around the circumference of the base. Where the heating chamber has more than one side wall, the side walls may be arranged to extend substantially around the circumference of the base. The heating chamber may have any suitable number of side walls. It will be appreciated that references to features of heating chambers having a single side wall apply equally to heating chambers having more than one side wall.

The chamfered or filleted intersection between the inner surfaces of the base and the side wall may extend substantially around the circumference of the base. The chamfered or filleted intersection may extend around the full or entire circumference of the base. In this arrangement, the intersections or corners between the internal surfaces the base and the side wall are effectively filled around the full circumference of the base, such that debris accumulating from any part of an aerosol-generating article accumulates on the chamfer or filet.

The opening of the heating chamber may be defined by a first end of the side wall. For example, the side wall may extend around the entire periphery of the base and extend away from the base in a substantially perpendicular direction, thereby forming a substantially cylindrical tube. The termination of the side wall at the first end, opposite the base, may provide an opening, with the heating chamber being defined within the tube, between the internal surfaces of the base and side wall. The opening is generally arranged oppose the base. In such an arrangement, the heating chamber may be configured to receive a portion of an aerosol-generating article that resembles a conventional cigarette.

The base may be formed integrally with the side wall of the heating chamber. In this configuration there may not be any separation between the base and the side wall. Therefore, there are no orifices or openings around the periphery of the base in which debris can fall or accumulate, so the device is easier to clean with a brush. Forming elements integrally may also simplify the manufacture and assembly of the device.

In some embodiments, the base is removable from the device. In this configuration the base of the heating chamber can be entirely removed from the heating chamber. The majority of debris accumulates on the base. Once the base is removed it may be more easily cleaned with a brush by a user as the movement of the brush is not limited within the confines of the heating chamber. In some embodiments, the base may be reusable. A reusable base may be removed and cleaned and the cleaned base may be reinserted in to the heating chamber. In some embodiments, the base may be disposable. In these embodiments, a base may be disposed of once it has been removed from the heating chamber, the base may be removed from the heating chamber and disposed of and a new base may be inserted into the heating chamber. The base may be removable from the heating chamber and insertable into the heating chamber through the opening at the first end of the heating chamber. Aerosol-forming substrate may be insertable into the heating chamber through the same opening as the base. This configuration may allow the heating chamber to have a single opening, which may enable the heating chamber to have a simple construction. Additionally, for embodiments with heaters extending into the heating chamber, this construction may limit the number of access points for a user to the heating chamber. This may substantially protect the user from contacting the heater when it is still hot.

The base may be removable from the heating chamber and insertable into the heating chamber through an opening in a side wall of the heating chamber. The opening in the side wall of the heating chamber may be adjacent to the second end of the heating chamber. Providing an opening in the side wall of the heating chamber allows this second opening to be configured specifically for use with the base. Positioning the opening adjacent to the second end of the heating chamber may minimise the distance the base must be moved within the heating chamber when it is being inserted or removed.

In some embodiments where the base is removable, the base may comprise engagement means for engaging with a removal tool. The tool may be any suitable tool for removal of the base from the heating chamber. The engagement means may be a notch in at least one side of the base. In such embodiments, the tool may include a hook or clip to engage with the notch so that the tool can engage with the base and be used to pull the base from the heating chamber. The engagement means may be a magnetic material arranged at least at a portion of the base. In such embodiments, the removal tool may include a magnetic material at one end for attracting the magnetic material of the base such that the tool may be used to pull the residue collector from the heating chamber.

The provision of a removal tool may eliminate the need for a user to directly touch the base during removal or insertion. This may be advantageous during removal when residue, such as debris, is accumulated on the base. The provision of a removal tool may also eliminate the need for the user to wait for the residue collector to cool down before removing it from the heating chamber.

The entire peripheral portion of the base may be contoured to provide a chamfered or filleted intersection between the base and the side wall.

The base may be formed of any suitable material.

In some embodiments, the base may be formed of a metal. A metal base may have a melting point that is significantly higher than the temperatures generated in the device during use. Therefore, the heating process should not affect or damage the base over time. Additionally, the base may be formed of a metal that has a high thermal conductivity, so that the base may transfer heat to the aerosol-forming substrate as the heating chamber is heated. In some embodiments, debris that accumulates at the base may be less likely to adhere to a heated base. Therefore, providing a base with a high thermal conductivity may enable the base to be more easily cleaned. Any suitable metal material could be used to form the base. Particular examples of suitable metals are aluminium or stainless steel.

In some embodiments, the base may be formed of a plastic material. A base formed of a plastic material may be conveniently produced by moulding. This may be an inexpensive and straightforward manufacture technique. Any suitable plastic material may be used to form the base. An exemplary suitable plastic material is PEEK.

It is also envisaged that the base may be provided with a coating, such as a low friction coating, to further reduce the adhesion of debris to the base.

As used herein, the term 'aerosol-forming substrate' relates to a substrate capable of releasing volatile compounds that can form an aerosol. The volatile compounds may be released by heating the aerosol-forming substrate. A suitable aerosol-forming substrate may comprise nicotine, a plant-based material, a homogenised plant-based material, or at least one aerosol-former or other additives or ingredients, such as flavourants. A suitable substrate may be in solid form, such as a tobacco plug. A tobacco plug may comprise one or more of: powder, granules, pellets, shreds, spaghettis, strips or sheets containing one or more of: tobacco leaf, fragments of tobacco ribs, reconstituted tobacco, homogenised tobacco, extruded tobacco and expanded tobacco. Optionally, the tobacco plug may contain additional tobacco or non-tobacco volatile flavour compounds, to be released upon heating of the tobacco plug.

Where the tobacco plug comprises homogenised tobacco material, the homogenised tobacco material may be formed by agglomerating particulate tobacco. The homogenised tobacco material may be in the form of a sheet. The homogenised tobacco material may have an aerosol-former content of greater than 5 percent on a dry weight basis. The homogenised tobacco material may have an aerosol former content of between 5 percent and 30 percent by weight on a dry weight basis. In some embodiments, sheets of homogenised tobacco material may be formed by agglomerating particulate tobacco obtained by grinding or otherwise comminuting one or both of tobacco leaf lamina and tobacco leaf stems. In some embodiments, sheets of homogenised tobacco material may comprise one or more of tobacco dust, tobacco fines and other particulate tobacco by-products formed during, for example, the treating, handling and shipping of tobacco. Sheets of homogenised tobacco material may comprise one or more intrinsic binders, tobacco endogenous binders, one or more extrinsic binders, tobacco exogenous binders, or a combination thereof to help agglomerate the particulate tobacco. In some embodiments, sheets of homogenised tobacco material may comprise other additives including, but not limited to, tobacco and non-tobacco fibres, aerosol-formers, humectants, plasticisers, flavourants, fillers, aqueous and non-aqueous solvents and combinations thereof. Sheets of homogenised tobacco material may be formed by a casting process of the type generally comprising casting a slurry comprising particulate tobacco and one or more binders onto a conveyor belt or other support surface, drying the cast slurry to form a sheet of homogenised tobacco material and removing the sheet of homogenised tobacco material from the support surface.

The aerosol-forming substrate may be adsorbed, coated, impregnated or otherwise loaded onto a carrier or support.

The aerosol-forming substrate may be provided as part of an aerosol-generating article. As used herein 'aerosol-generating article' relates to an article comprising an aerosol-forming substrate. An aerosol-generating article may be a non-combustible aerosol-generating article. A non-combustible aerosol-generating article is an article comprising an aerosol-forming substrate capable of releasing volatile compounds without combustion of the aerosol-forming substrate, for example by heating the aerosol-forming substrate, by a chemical reaction or by mechanical stimulus of the aerosol-forming substrate. An aerosol-generating article may be a smoking article that generates an aerosol that is directly inhalable into a user's lungs through the user's mouth. An aerosol-generating article may resemble a conventional smoking article, such as a cigarette. An aerosol-generating article may be disposable. An aerosol-generating article may be partially-reusable and may comprise a replenishable or replaceable aerosol-forming substrate.

As used herein, 'aerosol-generating device' relates to a device that interacts with an aerosol-forming substrate to generate an aerosol. An aerosol-generating device may comprise one or more components used to supply energy from a power supply to an aerosol-generating means to interact with an aerosol-forming substrate to generate an aerosol that is inhalable by a user. The power supply may be an external power supply or may form part of the device, such as an on-board battery. The aerosol-generating means may be any suitable means for generating an aerosol from an aerosol-forming substrate. For example, the aerosol-generating means may be an electric heater.

The aerosol-generating device may comprise aerosol-generating means. The aerosol-generating means may be any suitable aerosol-generating means. For example, the aerosol-generating means may comprise a heater configured to heat an aerosol-forming substrate received within the heating chamber of the device. The heater may be configured to heat the aerosol-forming substrate to generate an aerosol for inhalation by a user. The heater may be any suitable type of heater.

The heater may extend into the heating chamber. The heater may extend into the heating chamber through the base. The heater may be arranged centrally within the heating chamber and may extend through a central portion of the base. Heaters extending into the heating chamber may be arranged to penetrate aerosol-forming substrate received in the heating chamber. A heater of this sort may be referred to as an internal heater. As used herein, 'internal heater' relates to a heater that is configured to be inserted into an aerosol-forming substrate when the aerosol-forming substrate is received in the heating chamber. Internal heaters may be inserted into the aerosol-forming substrate in order to directly contact the aerosol-forming substrate within the aerosol-generating article. An internal heater is configured to heat an aerosol-forming substrate of an aerosol-generating article from within. The use of an internal heater may be advantageous because it may be in direct contact with the aerosol-forming substrate in order to efficiently heat the substrate. The inner portion of the base may be a relatively flat or planar portion. The inner portion of the base is located radially inward of the peripheral portion of the base.

In embodiments comprising a heater extending into the heating chamber through the base, the base may be contoured to provide a chamfered intersection or a filleted intersection between the base and at least one surface of the heater. This configuration effectively fills in the intersection between the base and one or more surfaces of the heater as the heater projects outwards from the base. If the heater extends through the base into the heating chamber substantially perpendicularly to the base, the intersections between surfaces of the heater and the base have an angle of 90°. If the heater extends through the base at an angle other than 90°, the intersections between surfaces of the heater and the base may vary between sides of the heater, and on one side at least there will be an acute angle between the heater and the base. In both of these configurations, debris that accumulates in the intersections will be difficult to clean with a cleaning tool, such as a brush. Providing a chamfer or fillet at the intersections fills in the sharp angle. The angles of the chamfered or filleted intersection may be relatively open, so they are easy to access with a cleaning tool, such as a brush, in order to be cleaned. In other words, a brush can more easily access the chamfered or filleted intersections to dislodge accumulated debris.

The heater may extend into the heating chamber in a direction substantially parallel to the side wall. The heater may extend substantially parallel to a longitudinal axis of a tubular or cylindrical heating chamber. The heater may extend along a portion of the length of the heating chamber. In some embodiments, the heater may extend substantially the full length of the heating chamber. When an aerosol-forming substrate is inserted into the heating chamber, the heater may be arranged to be in direct contact with a large proportion of the aerosol-forming substrate. As used herein, 'length' refers to the maximum longitudinal dimension of the device, the substrate or a portion or part of the device or the substrate, such as the distance between the second end of the heating chamber and the first end of the heating chamber (i.e., the distance between the base and the opening).

The heater may be located centrally in the heating chamber. In other words, the heater may extend substantially along the central longitudinal axis of the heating chamber. In this configuration the highest temperature generated within the heating chamber, at the heater, may be generated along the central longitudinal axis of the heating chamber. In this configuration, the heater may be arranged to heat aerosol-forming substrate within the heating chamber from a central region outwards, heating all sides of the aerosol-forming substrate evenly. The heater may be arranged substantially at an equal distance from the side wall of the heating chamber, on all sides.

In some embodiments, the heater may extend into the heating chamber substantially perpendicularly to the side wall. In such a configuration the heater may extend in a transverse direction across an elongate heating chamber. As used herein, the term 'transverse' relates to a direction perpendicular to the longitudinal dimension of the device, the substrate or a portion or a part of the device or the substrate, such as a direction perpendicular to the longitudinal axis of the heating chamber.

The heater may be an external heater. As used here, 'external heater' refers to a heater that does not penetrate an aerosol-forming substrate in the heating chamber or any part of an aerosol-generating article received in the heating chamber. An external heater may be positioned at or around an inner surface of the heating chamber. In some embodiments, an external heater may contact the outer surface of an aerosol-generating article received in the heating chamber. In some embodiments, an external heater may not directly or physically contact an aerosol-forming substrate or any part of an aerosol-generating article received in the heating chamber. An external heater may be positioned within the aerosol-generating device but outside of or external to the heating chamber. A heating chamber with an external heater may be referred to as an oven and the external heater may be referred to as an oven heater.

The heater may be any suitable type of heater. For example, the heater may be an electrically resistive heating element. Such a heating element may be connected directly to a power supply of the device and electrical current from a power supply of the device may be converted directly into heat at the resistive heating element. This type of heater may minimise the number of parts required within the device.

The heater may be part of a heating assembly. The heating assembly may be any suitable type of heating assembly. For example, the heating assembly may be an electric heating assembly. Where the heating assembly is an electric heating assembly, the aerosol-generating device may also comprise a power supply for providing power to the heating assembly.

It will be appreciated that there are many heating assemblies that may be used. For example, the heating assembly may comprise a heater in the form of a susceptor element extending into the heating chamber and the heating assembly may further comprises an inductor arranged at or around the heating chamber that is configured to heat the susceptor. For example, the inductor may comprise a coil arranged outside the heating chamber or surrounding the heating chamber that acts to induce heating currents in the susceptor.

FIG. 1*a* is a schematic illustration of a heating chamber 10 of an aerosol-generating device. The heating chamber 10 is configured to receive and heat an aerosol-forming substrate. The heating chamber 10 comprises a first end 12 having an opening 13, a second end 14 having a base 15, and a side wall 11 extending between the opening 13 and the base 15. The side wall 11 is a circularly cylindrical tube that is substantially closed at the second end 14 by the base 15, which is generally in the form of a planar circular disc. A cavity 17 is defined by inner surfaces of the base 15 and side wall 11. The heating chamber 10 is configured to receive aerosol-forming substrate in the cavity 17 through the opening 13 at the first end 12.

The heating chamber 10 includes an internal heater 18 in the form of an elongate, planar, heating blade having opposing first and second faces 18*a* and terminating at a point 18*b*. Opposing first and second faces 18*a* of the heater 18 are defined by the width and length of the heater 18. The heater 18 has a length dimension that is greater than its width dimension, which is greater than its thickness dimension. The heater 18 extends into the cavity 17 from the base 15 at the closed second end 14 of the heating chamber 10. The heater 18 is generally aligned along the central longitudinal axis of the heating chamber 10, perpendicular to the base 15, and parallel to the side wall 11.

An aerosol-forming substrate (not shown), such as a rod of tobacco, is generally provided as part of an aerosol-generating article, having the aerosol-forming substrate at a distal end and a filter at a proximal end. In use, the aerosol-forming substrate is inserted into the cavity 17 through the open end 12 of the heating chamber 10, such that the tapered point 18*b* of the heater 18 engages the substrate. By applying a force to the aerosol-generating article, the heater 18 penetrates into the aerosol-forming substrate. When the aerosol-generating article is fully engaged with the aerosol-generating device, the aerosol-forming substrate is substantially received in the cavity 17 and the heater 18 is surrounded by the aerosol-forming substrate. When the heater 18 is actuated, the aerosol-forming substrate is warmed by the heater 18 and volatile substances are generated or evolved from the substrate as vapour. As a user draws on the mouthpiece of the article, air is drawn into the aerosol-generating article and the volatile substances condense to form an inhalable aerosol. This aerosol is entrained in the air being drawn through the aerosol-generating article and passes through the mouthpiece of the aerosol-generating article and into the user's mouth.

Figure 1B:
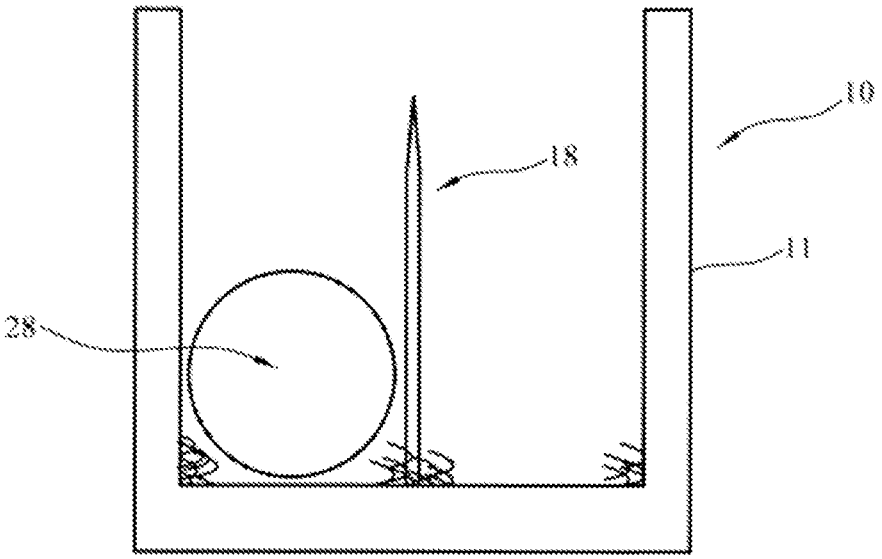
FIG. 1*b* shows the heating chamber of FIG. 1*a* including a brush

During insertion of aerosol-forming substrate into the cavity 17 of the heating chamber 10 and during removal of the substrate from the cavity, loose substrate may be released into the cavity 17, forming undesirable debris 22 at the base 15. Residue (not shown) from the substrate may also build up on the surfaces 18*a* of the heater 18. In FIGS. 1*a* and 1*b*, debris 22 is shown accumulated in the heating chamber 10 at the intersection 25 between the internal surface of the base 15 and the internal surface of the side wall 11. Debris 22 is also shown accumulating at the intersection 27 between the internal surface of the base 15 and the surfaces 18*a* of the heater 18.

A tool, such as a brush, may be provided for cleaning debris 22 from the heating chamber 10 and residue from the heater 18. In FIG. 1*b*, there is shown a cleaning brush 28 within the heating chamber 10. The head of the brush 28 has a circular longitudinal cross-section. Since the heating chamber has a substantially rectangular cross-section at the second end 14, the bristles (not shown) of the brush 28 do not reach into the corners or intersections 25, 27 of the heating chamber 10. The bristles of the brush 28 may be deformable in order to allow some bristles to reach the intersections 25, 27 of the heating chamber 10. However, deforming the bristles of the brush 28 in order to reach the intersections 25, 27 may unacceptably increase the effort required by the user to clean the heating chamber 10, may damage the brush or may reduce the effectiveness of the brush by requiring the bristles to be softer or more deformable than optimal.

Figure 2A:
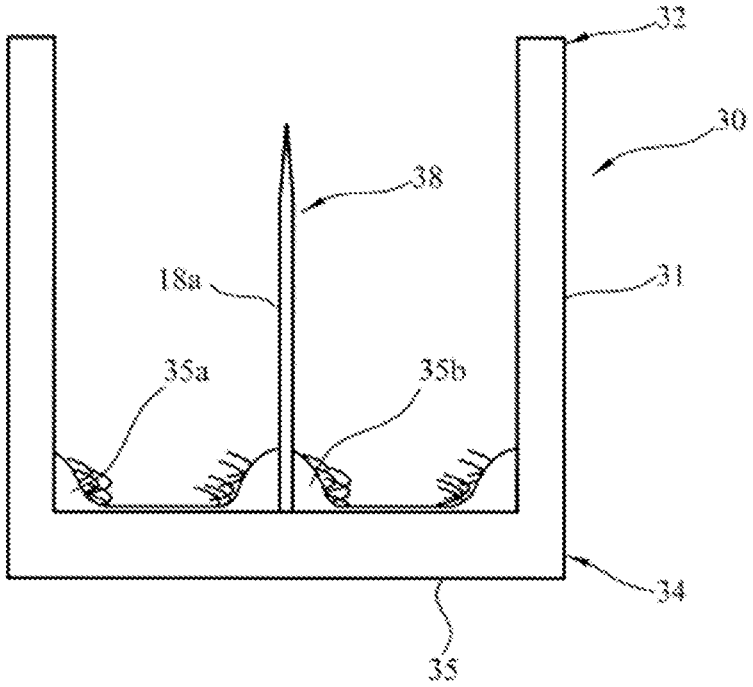
FIG. 2*a* shows a cut-through view of an internally heated heating chamber according to an embodiment of the invention.

In FIG. 2*a*, there is shown a heating chamber 30 according to an embodiment of the present invention. The heating chamber 30 is substantially similar to the heating chamber 10 of FIG. 1*a* having a side wall 31 identical to the side wall 11, a first end 32 identical to the first end 12, and an identical heater 38 to the heater 18. However, the heating chamber 30 has a base 35 at a second end 34 that is contoured at its periphery to create a chamfer 35*a* around the outer edge of the base 35 between the internal surface of the base 35 and the side wall 31. The chamfer 35*a* is a substantially straight edge that extends between the inner surface of the base 35 and the inner surface of the side wall 31 to effectively fill in the intersection between the inner surface of the base 35 and inner surface of the external wall 31. The chamber 35*a* extends upwards from the general plane of the base 35 at an angle of about 135°. The outer edge of the chamfer 35*a* abuts the inner surface of the side wall 31 around the entire circumference of the side wall 31 at an angle of about 135°. The base 35 is further contoured at a central region to create an internal chamfer 35*b* between the internal surface of the base 35 and the surfaces 38*a* of the heater 38. The internal chamfer 35*b* extends between the internal surface of the base 35 and the heater blade surfaces 38*a* to effectively fill the intersection between the inner surface of the base 35 and the heater surfaces 38*a*. The internal chamfer 35*b* extends upwards from the general plane of the base at an angle of about 135° and the inner edge of the internal chamfer 35*b* abuts the heater surfaces 38*a* around the full circumference of a lower portion of the heater at an angle of about 135°.

Figure 2B:
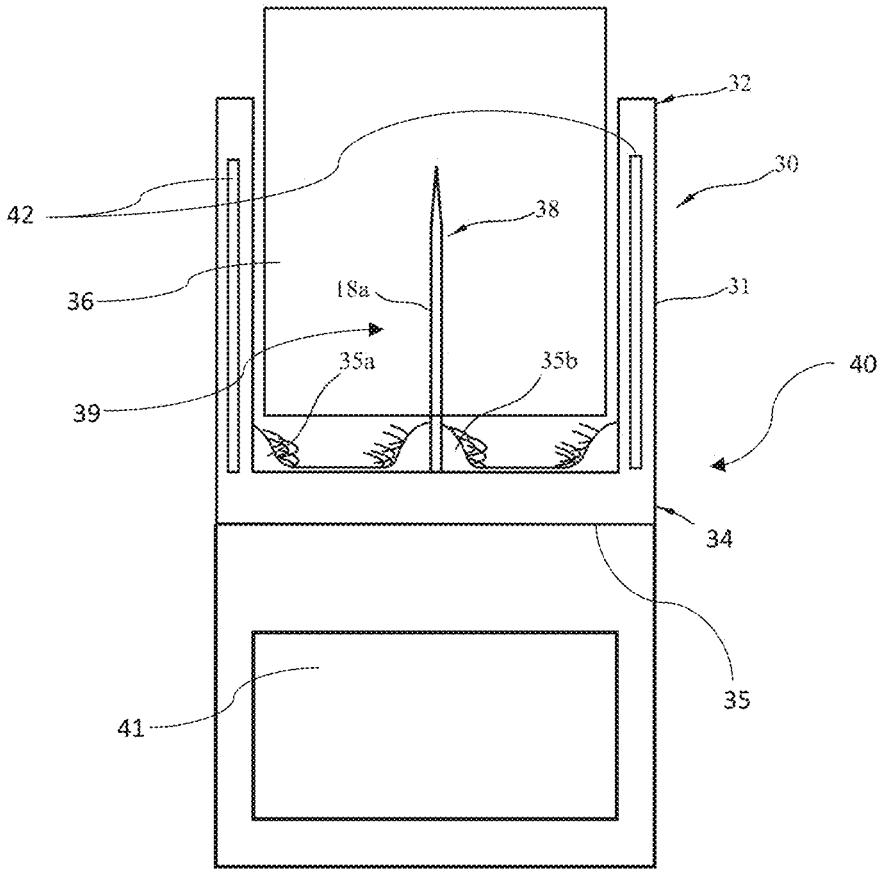
FIG. 2*b* shows a cut-through view of an aerosol-generating device according to an embodiment of the invention including the internally heated heating chamber of FIG. 2*a;*

In FIG. 2*b*, there is shown an aerosol-generating device 40 comprising the heating chamber 30. An aerosol-forming substrate 36 is inserted into the heating chamber 30 of the aerosol-generating device 40, such that the heater 38 penetrates into the aerosol-forming substrate 36. The heater 38 is part of a heating assembly 39. The heating assembly 39 is an electric heating assembly. The aerosol-generating device 40 also comprises a power supply 41 for providing power to the heating assembly 39. The heater assembly 39 also includes an inductor coil 42.

Figure 2C:
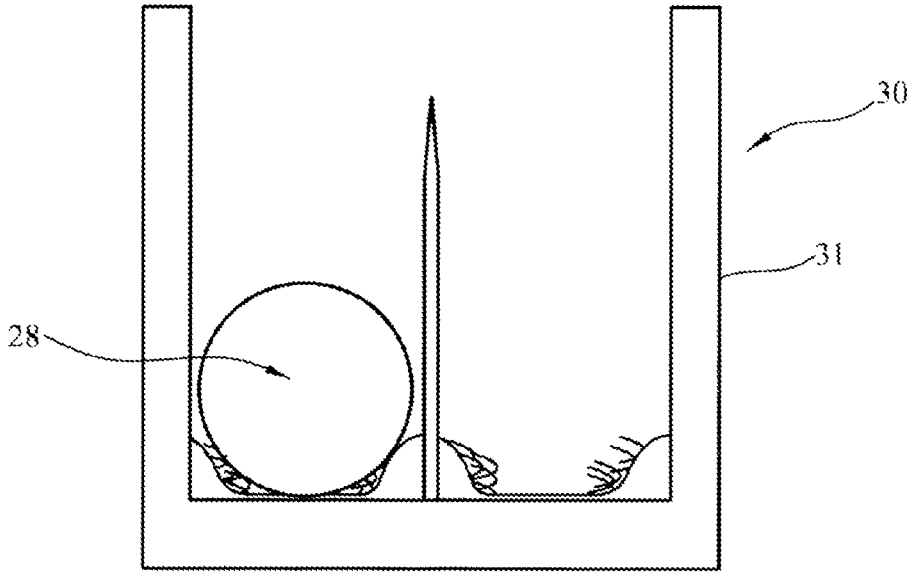
FIG. 2*c* shows the heating chamber of FIG. 2*a* including a brush.

In FIG. 2*c* there is shown the brush 28 within the heating chamber 30. The circular profile of the brush 28 corresponds closely to the profile of the inner surface of the base 35, in particular at the chamfers 35*a*, 35*b*. When the brush 28 is inserted into the heating chamber 30, the bristles (not shown) are able to contact the whole surface of the chamfers 35*a*, 35*b*. Therefore, the brush 28 can dislodge debris and reside from all of the inner surfaces of the heating chamber, including the whole surface of the chamfers 35*a*, 35*b*.

In the embodiment of FIGS. 2*a*, 2*b*, and 2*c*, the base 35 is formed integrally with the external wall 31 to define the heating chamber.

Figure 3A:
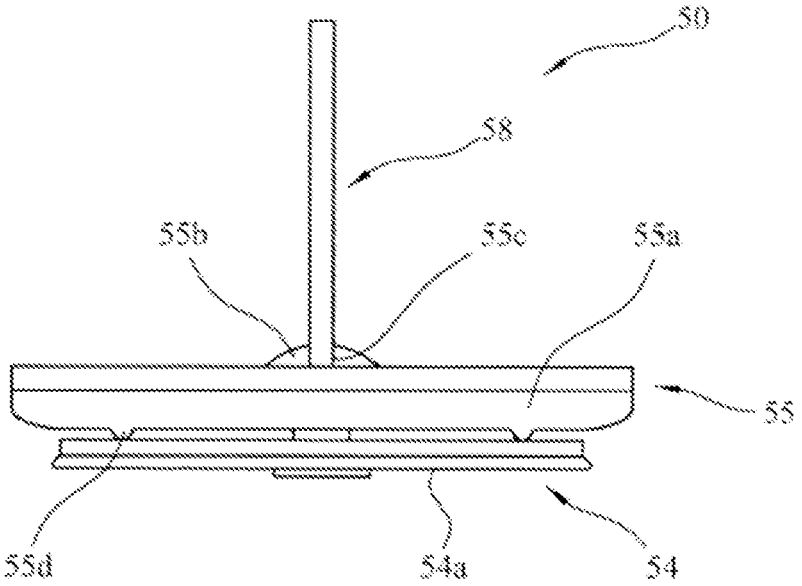
FIG. 3*a* shows a side view of a removable base according to a second embodiment of the present invention, positioned around a heater blade.
Figure 3B:
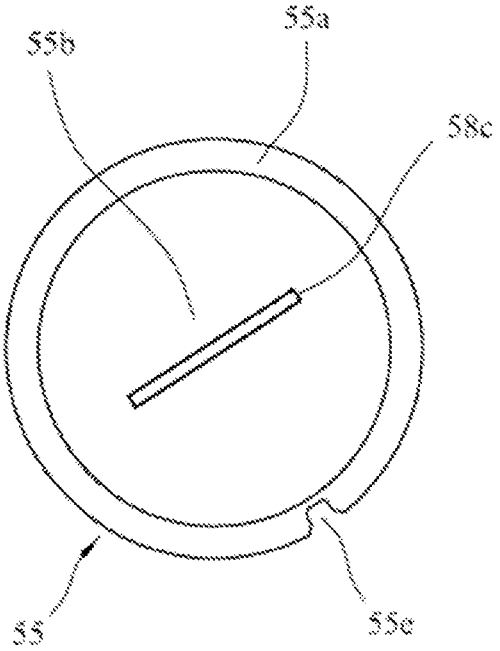
FIG. 3*b* shows a top view of a removable base according to a second embodiment of the present invention.
Figure 3C:
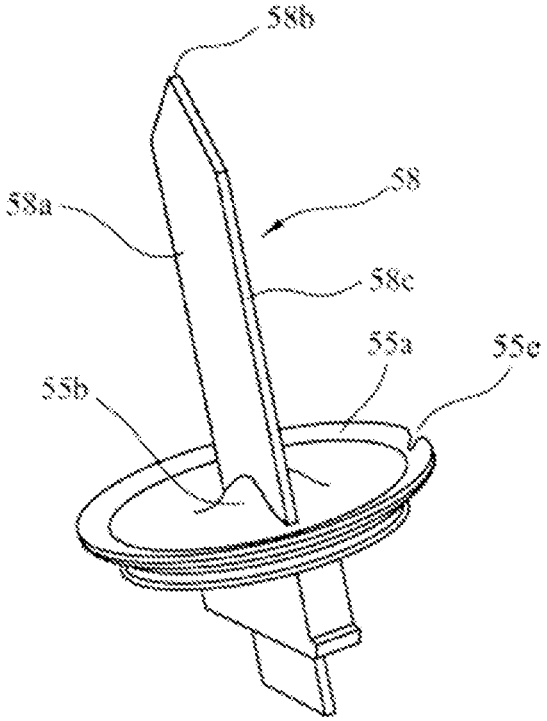
FIG. 3*c* shows a perspective view of a removable base according to a second embodiment of the present invention positioned around a heater blade.

An alternative embodiment is shown in FIGS. 3*a*, 3*b*, and 3*c*, wherein the base 55 is removable from the heating chamber 50. The heating chamber 50 of this embodiment has a closed second end 54 that is defined by an end portion 54*a*. FIG. 3*a* shows the removable base 55 positioned within the heating chamber at the closed second end 55 (with the sidewall removed to show the base in situ). The base 55 is a substantially planar disk-shaped element, with a raised peripheral edge forming an outer filleted edge 55*a* and a raised central portion around a central slot 55*c* forming an internal filleted edge 55*b*. In this embodiment, the base 55 comprises fillets, rather than chamfers, at the outer periphery and at a central region. The fillets 55*a*, 55*b* provide a curved edge at the intersections between the internal surface of the base 55 and the side wall (not shown) and the internal surface of the base 55 and the heater 58.

The slot 55*c* is arranged and dimensioned to receive the elongate, planar, heating blade 58, such that the inner edge of the internal fillet 55*b* abuts the surfaces 58*a* of a lower portion of the heating element 58. The base 55 includes a circular raised lip 55*d* that projects downwards from the lower surface of the base 55 to engage with the end portion 54*a* of the heating chamber 50 to space the lower surface of the base 55 from the end portion 54*a*. It will be appreciated that in other embodiments the circular lip may be replaced with a plurality of feet elements, for example three or four feet elements spaced evenly around the base.

In this embodiment, the internal fillet 55*b* does not extend around the full periphery of the heater 58. In this embodiment, the base 55 is not raised at the narrow edges 58*c* of the heater 58 as there is little debris accumulation at the narrow edges 58*c*. In other words, the height of the internal fillet 55*b* varies around the periphery of the heater 58. The height of the internal fillet 55*b* rises gradually from the narrow edges 58*c* of the heater 58 across the faces 58*a* of the heater 58 to the centre of each face 58*a*, providing a curved fillet profile across the faces 58*a* of the heater 58. It will be appreciated that in other embodiments, the internal fillet 55*b* may extend around the full periphery of the heater 58 or may have any other suitable profile across the faces 58*a* of the heater.

The removable base 55 is inserted into the heating chamber 50 through the open end (not shown) of the heating chamber 50. The heater 58 is received in the slot 55*c* and the base 55 is lowered into the cavity of the heating chamber 50 until the base 55 is in position at the closed end 54, with the raised lip 55*d* abutting the end portion 54*a* of the heating chamber 50. When the base 55 is positioned in this manner, the device is ready for use. For removal of the base 55 from the heating chamber 50, a removal tool (not shown) may be inserted into the heating chamber 50 and may engage with the base 55 at a removal notch 55*e* at the periphery of the base 55. The tool may hook underneath the base 55 or attach to the base 55 at the notch 55*e*, and the user may pull the tool and the base 55 out of the heating chamber 50. The base 55 may be cleaned and replaced in the heating chamber 50, or may be disposed of and a new base 55 inserted into the heating chamber 50, as described above.

It will be appreciated that both integral and removable bases may be provided with chamfered or filleted intersections. In some embodiments, the base may comprise a chamfered intersection at one of the outer and inner intersections and a filleted intersection at the other one of the outer and inner intersection.

The invention claimed is:

1. An aerosol-generating device for heating an aerosol-forming substrate to form an inhalable aerosol, the aerosol-generating device comprising:

a heating chamber configured to heat an aerosol-forming substrate, the heating chamber comprising a first end having an opening, a second end having a base, and a side wall extending between the opening and the base, in which a cavity is defined by inner surfaces of the base and side wall;

a heating assembly; and a power supply, wherein the heating assembly comprises a heater extending into the heating chamber through an inner portion of the base, and wherein the inner portion of the base is contoured to provide a chamfered or filleted intersection between the base and the heater.

2. The aerosol-generating device according to claim 1, wherein the side wall extends substantially in a direction perpendicular to the base.

3. The aerosol-generating device according to claim 1, wherein the chamfered or filleted intersection between the inner surfaces of the base and the side wall extends substantially around a circumference of the base.

4. The aerosol-generating device according to claim 1, wherein the heater is a resistive heater or an inductive heater.

5. The aerosol-generating device according to claim 1, wherein the heater is a susceptor and the heating assembly further comprises an inductor coil.

6. The aerosol-generating device according to claim 1, wherein the heater substantially extends into the heating chamber in a direction parallel to the side wall.

7. The aerosol-generating device according to claim 1, wherein the heating assembly further comprises an external heater.

8. The aerosol-generating device according to claim 1, wherein the opening of the heating chamber is defined by the side wall, the opening configured to oppose the base.

9. The aerosol-generating device according to claim 1, wherein the base is formed integrally to the side wall of the heating chamber.

10. The aerosol-generating device according to claim 1, wherein the base is removable from the aerosol-generating device.

11. The aerosol-generating device according to claim 10, wherein the base is removable and insertable through the opening at the first end of the heating chamber.

12. The aerosol-generating device according to claim 10, wherein the base is removable and insertable through an opening in a side wall of the heating chamber adjacent to the second end of the heating chamber.

13. The aerosol-generating device according to claim 10, wherein the base has engagement means for engagement with a removal tool.

* * * * *